US008994632B2

(12) United States Patent
Kato et al.

(10) Patent No.: US 8,994,632 B2
(45) Date of Patent: Mar. 31, 2015

(54) LIQUID CRYSTAL DISPLAY DEVICE

(71) Applicant: Japan Display East Inc., Mobara-shi, Chiba-ken (JP)

(72) Inventors: Keitoku Kato, Mobara (JP); Hiroyuki Nitta, Fujisawa (JP); Gou Yamamoto, Mobara (JP)

(73) Assignee: Japan Display Inc., Tokyo (JP)

( * ) Notice: Subject to any disclaimer, the term of this patent is extended or adjusted under 35 U.S.C. 154(b) by 16 days.

(21) Appl. No.: 13/851,125

(22) Filed: Mar. 27, 2013

(65) Prior Publication Data

US 2013/0271439 A1 Oct. 17, 2013

(30) Foreign Application Priority Data

Apr. 12, 2012 (JP) ..... 2012-090773

(51) Int. Cl.
*G09G 3/36* (2006.01)

(52) U.S. Cl.
CPC ..... *G09G 3/3614* (2013.01); *G09G 3/3685* (2013.01); *G09G 2300/0434* (2013.01); *G09G 2310/06* (2013.01)
USPC ..... 345/96; 345/209

(58) Field of Classification Search
CPC . G09G 3/3614; G09G 3/3648; G09G 3/3688; G09G 2330/021; G09G 2320/0233; G09G 2310/027; G09G 2320/0247; G09G 2310/0297; G09G 3/3611; G09G 3/3659
USPC ..... 345/208, 209, 210, 211, 212, 204, 87, 345/96, 54, 79
See application file for complete search history.

(56) References Cited

U.S. PATENT DOCUMENTS

| | | | | |
|---|---|---|---|---|
| 5,995,073 | A * | 11/1999 | Isami et al. | 345/89 |
| 2008/0246718 | A1 | 10/2008 | Tanaka | |
| 2010/0289786 | A1 * | 11/2010 | Tanaka et al. | 345/209 |
| 2011/0216052 | A1 * | 9/2011 | Tanaka | 345/209 |

FOREIGN PATENT DOCUMENTS

| | | |
|---|---|---|
| JP | 2008-256811 | 10/2008 |

* cited by examiner

*Primary Examiner* — Duc Dinh
(74) *Attorney, Agent, or Firm* — Lowe Hauptman & Ham, LLP

(57) ABSTRACT

A liquid crystal display device includes a plurality of video signal lines that extends in columns in a display area, a plurality of inversion control signal line each supplied with an inversion control signal for controlling inversion, a first selector that selects one of a pair of amplifiers different in the polarity from each other to input signals corresponding to a pair of adjacent video signal lines on the basis of the inversion control signal, and a second selector that selects one of a pair of the corresponding adjacent video signal lines to input signals output from the pair of amplifiers on the basis of the inversion control signal, in which at least one of the signals to be supplied to the plurality of inversion control signal lines is a signal different from other signals.

4 Claims, 16 Drawing Sheets

Hsync
CONTROL SIGNAL GENERATOR CIRCUIT
330
321
322
323
324
320
300
302
DATA LATCH CIRCUIT
304
306
DAC CIRC -UIT
308
309
310
401
402
403
404
405
406
407
408
PATH A
PATH B

FIG.7

| | 401 | 402 | 403 | 404 | 405 | 406 | 407 | 408 | | | | | | | | | | |
|---|---|---|---|---|---|---|---|---|---|---|---|---|---|---|---|---|---|---|
| a | + | − | + | − | + | − | + | − | + | − | + | − | + | − | + | − | + | |
| b | + | − | + | − | + | − | − | + | + | − | + | − | + | − | − | + | + | |
| c | + | − | + | − | − | + | − | + | + | − | + | − | − | + | − | + | + | |
| d | + | − | − | + | − | + | − | + | + | − | − | + | − | + | − | + | + | |
| e | − | + | − | + | − | + | − | + | − | + | − | + | − | + | − | + | − | |
| f | − | + | − | + | − | + | + | − | − | + | − | + | − | + | + | − | − | |
| g | − | + | − | + | + | − | + | − | − | + | − | + | + | − | + | − | − | |
| h | − | + | + | − | + | − | + | − | − | + | + | − | + | − | + | − | − | |
| i | + | − | + | − | + | − | + | − | + | − | + | − | + | − | + | − | + | |
| j | + | − | + | − | + | − | − | + | + | − | + | − | + | − | − | + | + | |
| k | + | − | + | − | − | + | − | + | + | − | + | − | − | + | − | + | + | |
| l | + | − | − | + | − | + | − | + | + | − | − | + | − | + | − | + | + | |

FIG.10

| | 421 | 422 | 423 | 424 | 425 | 426 | 427 | 428 | | | | | | | | | | |
|---|---|---|---|---|---|---|---|---|---|---|---|---|---|---|---|---|---|---|
| a | + | - | + | - | + | - | + | - | + | - | + | - | + | - | + | - | + | |
| b | + | - | + | - | + | - | + | - | + | - | + | - | + | - | + | - | + | |
| c | + | - | + | - | + | - | + | - | + | - | + | - | + | - | + | - | + | |
| d | + | - | + | - | + | - | + | - | + | - | + | - | + | - | + | - | + | |
| e | - | + | + | - | + | - | + | - | - | + | + | - | + | - | + | - | - | |
| f | - | + | - | + | + | - | + | - | - | + | - | + | + | - | + | - | - | |
| g | - | + | - | + | - | + | + | - | - | + | - | + | - | + | + | - | - | |
| h | - | + | - | + | - | + | - | + | - | + | - | + | - | + | - | + | - | |
| i | + | - | - | + | - | + | - | + | + | - | - | + | - | + | - | + | + | |
| j | + | - | - | + | - | + | - | + | + | - | - | + | - | + | - | + | + | |
| k | + | - | + | - | - | + | - | + | + | - | + | - | - | + | - | + | + | |
| l | + | - | + | - | - | + | - | + | + | - | + | - | - | + | - | + | + | |

Hsync
CONTROL SIGNAL GENERA -TOR CIRCUIT
DATA LATCH CIRC -UIT
DAC CIRC -UIT
600
302
304
306
308
309
310
431
432
433
434
435
436
437
438
439
440
441
442
443
444
445
446
620
621
622
623
624
625
626
627
628
630
PATH A
PATH B

FIG.14

| | 431 | 432 | 433 | 434 | 435 | 436 | 437 | 438 | 439 | 440 | 441 | 442 | 443 | 444 | 445 | 446 |
|---|---|---|---|---|---|---|---|---|---|---|---|---|---|---|---|---|
| a | + | - | + | - | + | - | + | - | + | - | + | - | + | - | + | - | + |
| b | + | - | + | - | + | - | + | - | + | - | + | - | + | - | + | - | + |
| c | - | + | + | - | + | - | + | - | + | - | + | - | + | - | + | - | - |
| d | - | + | - | + | + | - | + | - | + | - | + | - | + | - | + | - | - |
| e | + | - | - | + | - | + | + | - | + | - | + | - | + | - | + | - | + |
| f | + | - | - | + | - | + | - | + | + | - | + | - | + | - | + | - | + |
| g | - | + | + | - | - | + | - | + | - | + | + | - | + | - | + | - | - |
| h | - | + | + | - | - | + | - | + | - | + | + | - | + | - | + | - | - |
| i | + | - | + | - | + | - | - | + | - | + | - | + | + | - | + | - | + |
| j | + | - | - | + | + | - | - | + | - | + | - | + | - | + | + | - | + |
| k | - | + | - | + | + | - | + | - | - | + | - | + | - | + | - | + | - |
| l | - | + | - | + | + | - | + | - | - | + | - | + | - | + | - | + | - |

LIQUID CRYSTAL DISPLAY DEVICE

CROSS-REFERENCE TO RELATED APPLICATION

The present application claims priority from Japanese application JP2012-090773 filed on Apr. 12, 2012, the content of which is hereby incorporated by reference into this application.

BACKGROUND OF THE INVENTION

1. Field of the Invention

The present invention relates to a liquid crystal display device.

2. Description of the Related Art

As a display device for an information communication terminal such as a computer or a television, a liquid crystal display device has been extensively used. The liquid crystal display device changes an electric field to change an orientation of a liquid crystal composition confined between two substrates, and controls the degree of transmission of a light transmitted through those two substrates and the liquid crystal composition to display an image. In order to change the electric field, the liquid crystal display device applies a voltage corresponding to a gradation value of each pixel to a pixel electrode through a pixel transistor of each pixel.

The liquid crystal composition has a property that the orientation becomes fixed when a voltage of the same polarity continues to be applied to the liquid crystal composition for a long time, which results in a residual image phenomenon. Also, the transistor also has a property that a threshold value for rendering the transistor conductive becomes shifted when being continuously applied with a voltage of one polarity. For that reason, in the liquid crystal display device, it is general to display an image by so-called "inversion driving" which drives while inverting the polarity of electric charge.

JP 2008-256811 A discloses a so-called dot inversion driving that prevents flicker.

SUMMARY OF THE INVENTION

The inversion driving largely affects a power consumption of a panel by the driving method. Up to now, in the liquid crystal display device of a so-called IPS (in plane switching) system having pixel electrodes and a common electrode which is a counter electrode of the pixel electrodes on one substrate, line inversion driving that changes the potential of the common electrode has been mainstream. However, from the viewpoint of the power consumption, the dot inversion driving that conducts the inversion driving using the potential of a polarity different from that of up and down, left and right pixels is used without changing the potential of the common electrode.

On the other hand, in particular, in order to improve the visibility in the liquid crystal display device of the middle and small sizes, a so-called "delta pixel array" in which pixels R (red), G (green), and B (blue) are arrange to form a triangle is frequently used. According to the present inventors' study, in the delta pixel array, it is confirmed that an oblique stripe pattern is visually recognized when the dot inversion driving is applied. FIGS. 15 and 16 illustrate a case in which monochromatic display of G (green) pixels is conducted and a case in which white display is conducted, in the dot inversion where the respective pixels are inverted every three horizontal synchronous periods, respectively. Also, FIGS. 17 and 18 illustrate a case in which the monochromatic display of G pixels is conducted and a case in which the white display is conducted, in the dot inversion where the respective pixels are inverted every four horizontal synchronous periods, respectively. In any cases, one polarity is regularly arrayed, and the stripe pattern has been visually recognized.

The present invention has been made under the above-mentioned circumstances, and an object of the present invention is to provide a liquid crystal display device in which no stripe pattern occurs in the dot inversion driving.

According to the present invention, there is provided a liquid crystal display device, including a display area in which a plurality of pixels is arrayed; a plurality of video signal lines that extends in columns in the display area, and applies a video signal voltage based on a gradation value to the plurality of pixels; a plurality of inversion control signal lines each supplied with an inversion control signal for controlling inversion drive; a first selector that selects one of a pair of amplifiers different in the polarity from each other to input signals corresponding to a pair of adjacent video signal lines on the basis of the inversion control signal that is applied to one inversion control signal line among the plurality of inversion control signal lines; and a second selector that selects one of a pair of the corresponding adjacent video signal lines to input signals output from the pair of amplifiers on the basis of the inversion control signal of the one inversion control signal line, in which at least one of the signals to be applied to the plurality of inversion control signal lines is a signal different from other signals.

Also, in the liquid crystal display device according to the present invention, the at least one signal is a signal different in cycle from the other signals.

Also, in the liquid crystal display device according to the present invention, the at least one signal is a signal identical in cycle and different in phase from the other signals.

Also, in the liquid crystal display device according to the present invention, a pixel array in the display area is a delta pixel array.

BRIEF DESCRIPTION OF THE DRAWINGS

FIG. 7 is a diagram illustrating the polarities of the respective pixels when a white display is conducted under the signal control in FIG. 5;

FIG. 10 is a diagram illustrating the polarities of the respective pixels when a white display is conducted under the signal control in FIG. 8;

FIG. 14 is a diagram illustrating the polarities of the respective pixels when a white display is conducted under the signal control in FIG. 12;

DETAILED DESCRIPTION OF THE INVENTION

Figure 1:
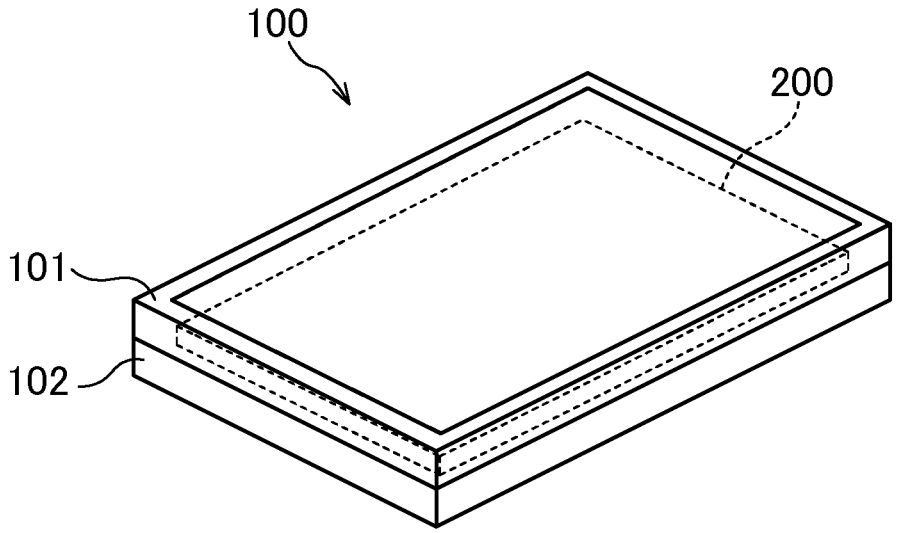
FIG. 1 is a diagram schematically illustrating a liquid crystal display device according to a first embodiment of the present invention.

Hereinafter, first to third embodiments of the present invention will be described with reference to the accompanying drawings. In the drawings, the same or equivalent elements are denoted by identical symbols, and a repetitive description will be omitted.

First Embodiment

FIG. 1 is a diagram schematically illustrating a liquid crystal display device 100 according to a first embodiment of the present invention. As illustrated in FIG. 1, the liquid crystal display device 100 includes an upper frame 110, a lower frame 120, and a liquid crystal display panel 200 fixed to be sandwiched between the upper frame 110 and the lower frame 120.

Figure 2:
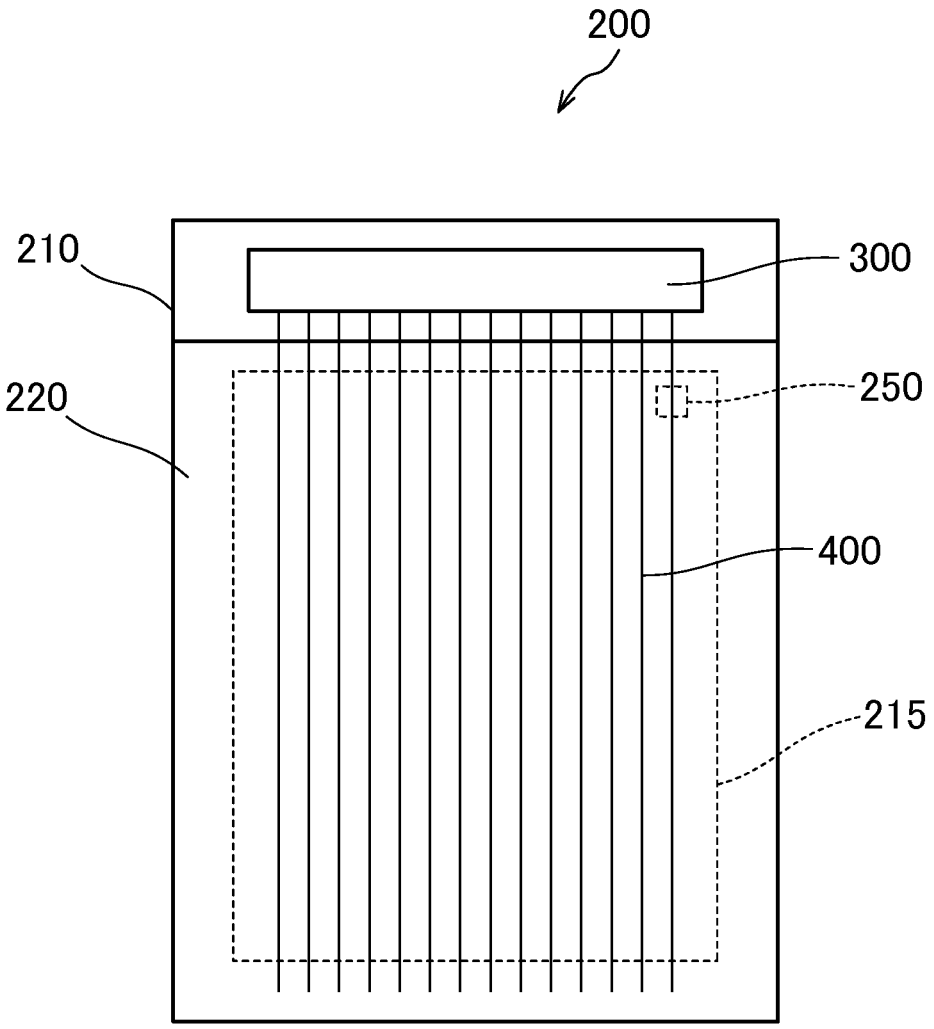
FIG. 2 is a plan view schematically illustrating a liquid crystal display panel of FIG. 1.

FIG. 2 is a plan view schematically illustrating the liquid crystal display panel 200 of FIG. 1. As illustrated in FIG. 2, the liquid crystal display panel 200 includes a thin film transistor substrate (hereinafter referred to as "TFT substrate") 210 on which thin film transistors for applying a voltage corresponding to a gradation value to each of pixels 250 in a display area 215 are formed, a color filter substrate 220 on which a color filter of RGB is formed on each of the pixels 250; a liquid crystal composition not shown which is sealed between the TFT substrate 210 and the color filter substrate 220, and changes brightness of each of the pixels 250 according to an orientation of the liquid crystal composition; video signal lines 400 through which a voltage corresponding to the gradation value is applied to the thin film transistor arranged in each of the pixels 250; and a driver IC (integrated circuit) 300 that drives each of the thin film transistors to hold the voltage corresponding to the gradation value applied to each of the video signal lines 400 in each of the pixels 250.

Figure 3:
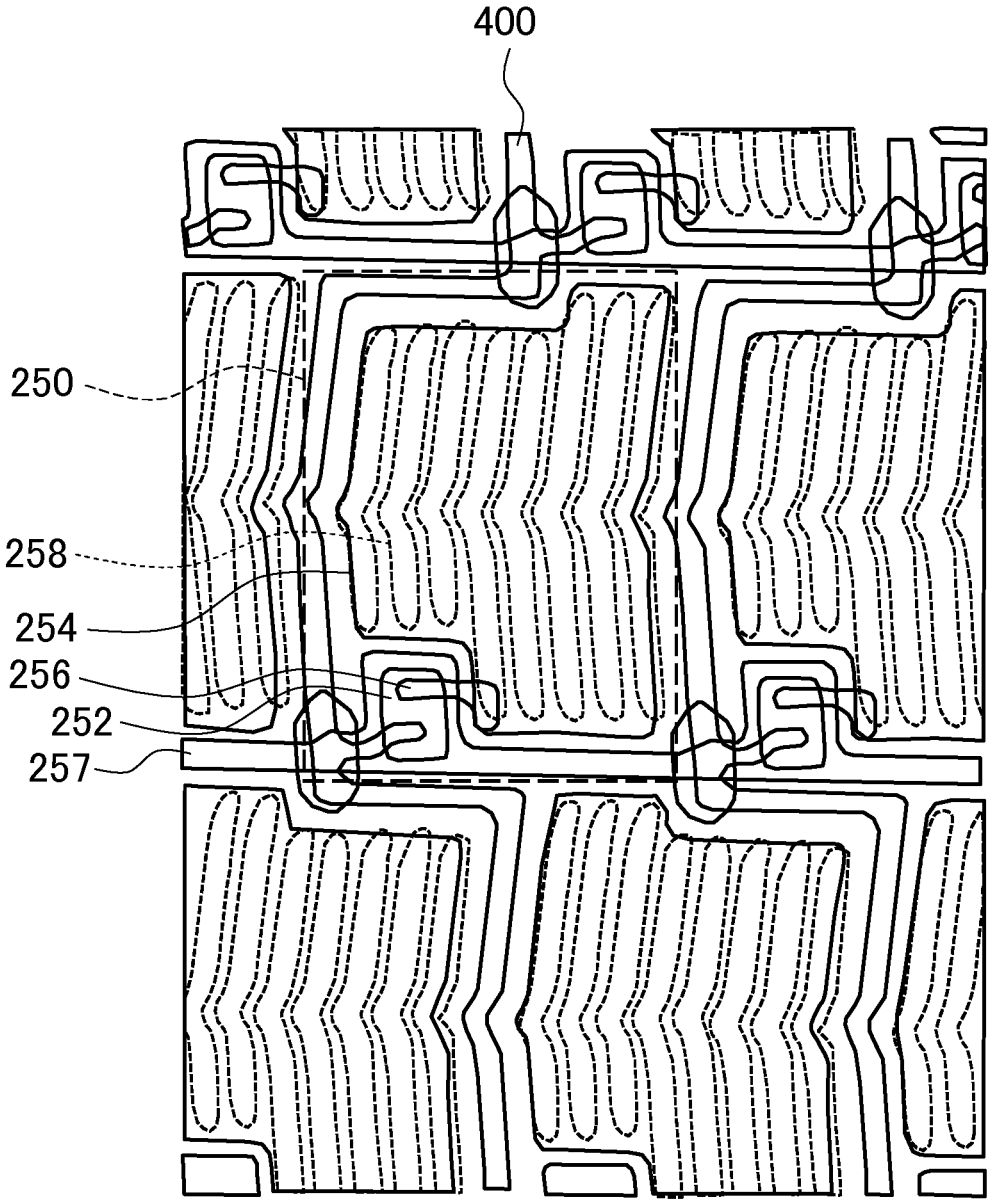
FIG. 3 is an enlarged view illustrating an arrangement of respective pixels and a state of electrodes on a TFT substrate in FIG. 2.

FIG. 3 is an enlarged view illustrating an arrangement of respective pixels and a state of electrodes on the TFT substrate 210. As illustrated in FIG. 3, in one pixel 250 of RGB, a voltage for rendering a semiconductor film 252 conductive is applied to the semiconductor film 252 in the order from a higher scanning signal line 257. As a result, the voltage corresponding to the gradation value applied to each video signal line 400 is applied and held into a drain line 256 and a pixel electrode 254. A common electrode 258 that develops an electric field for orienting the liquid crystal component in cooperation with the pixel electrode 254 is formed into a planar shape expanding over an overall display area, and has a plurality of slender holes opened for each of the pixels 250. Also, the respective pixels 250 of RGB are in a delta pixel array where the pixels of three colors of RGB are arrayed to form a triangle.

Figure 4:
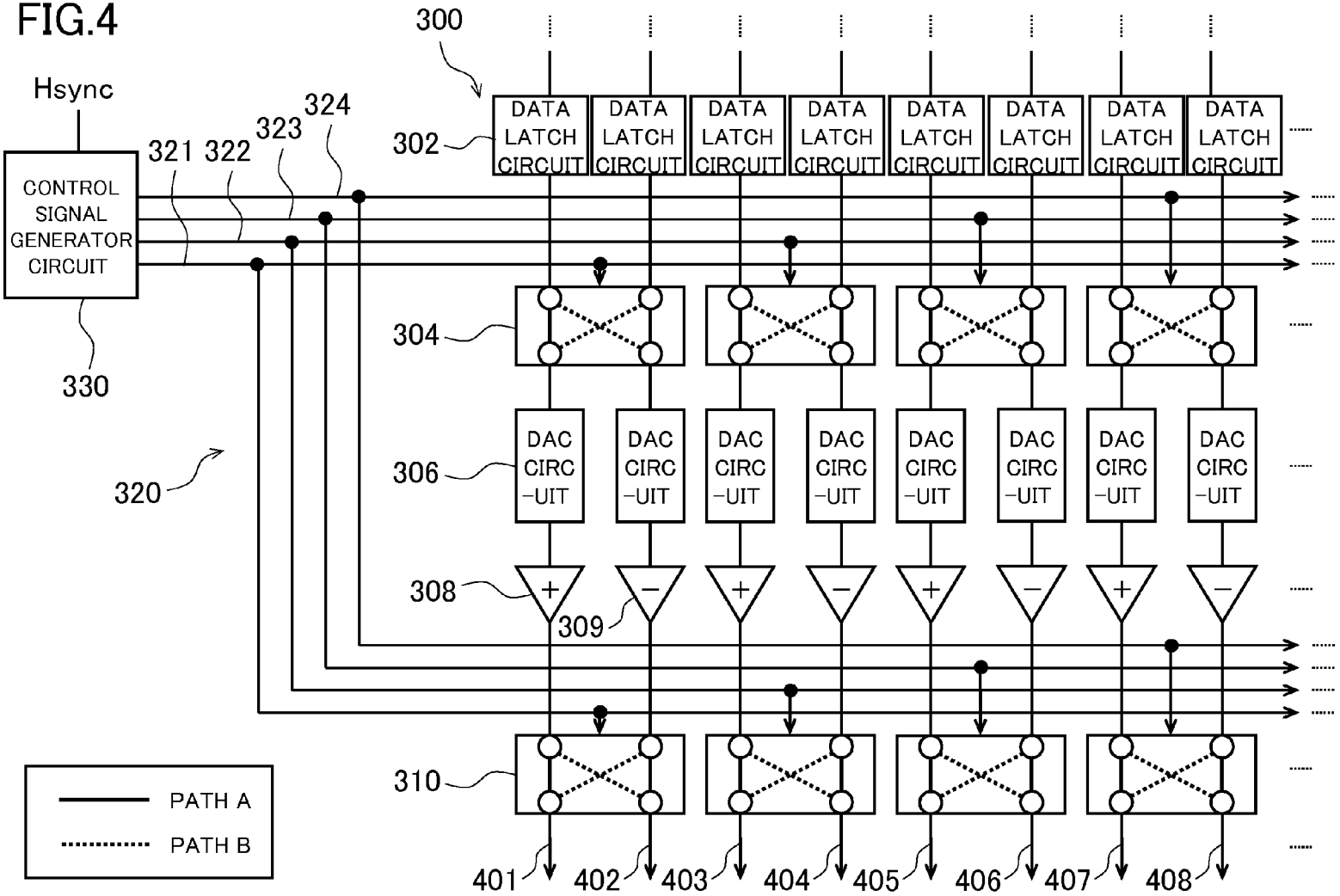
FIG. 4 is a diagram schematically illustrating a part of a circuit within a driver IC in FIG. 2.

FIG. 4 is a diagram schematically illustrating a part of a circuit within the driver IC 300 in FIG. 2. As illustrated in FIG. 4, the driver IC 300 includes data latch circuits 302 that hold display data corresponding to video signals 401 to 408 which are output to the video signal lines 400, DAC (digital analog converter) circuits 306 that receive the outputs of the adjacent data latch circuits 302, and convert digital data of the display data into drive voltages, first selectors 304 that are circuits that select and output any one of the adjacent DAC circuits according to alternating timing of control signals 321 to 324 which are supplied to inversion control signal lines 320, positive amplifier circuits 308 that are buffer circuits for driving drive voltages generated by the DAC circuits 306 and amplifier circuits for positive poles of liquid crystal alternating, negative amplifier circuits 309 that are amplifier circuits for negative poles of liquid crystal alternating adjacent to the positive amplifier circuits 308 and paired with the positive amplifier circuits 308, second selectors 310 that are circuits that receive drive voltages output from the amplifier circuits, and selectively output any one of two adjacent video signal output according to the alternating timings, and a control signal generator circuit 330 that receives a horizontal synchronous signal Hsync, and inverts the polarities of the control signals 321 to 324 on a horizontal synchronous signal Hsync basis. In the figure, the video signals 401 to 408 are supplied to the plurality of video signal lines 400. The first selectors 304 and the second selectors 310 select paths A upon receiving a signal of high from the control signals 321 to 324, and select paths B upon receiving a signal of low from the control signals 321 to 324. The positive amplifier circuits 308 and the negative amplifier circuits 309 are pairs of amplifiers corresponding to the adjacent video signal lines 400.

Figure 5:
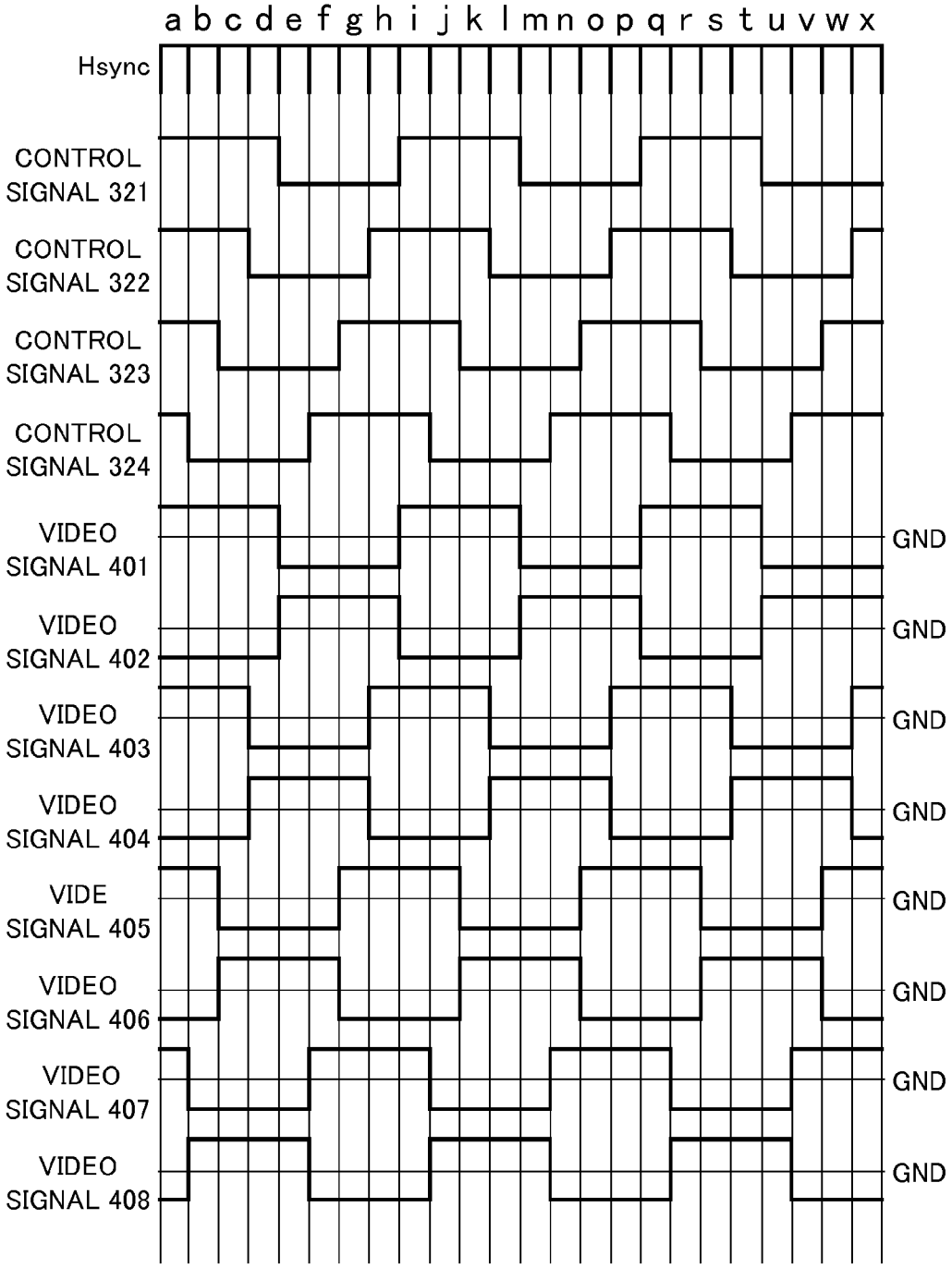
FIG. 5 is a timing chart of control signals and video signals in FIG. 4.

FIG. 5 is a timing chart of the control signals 321 to 324 and the video signals 401 to 408 in FIG. 4. In the timing chart, a source signal is indicative of positive when the signal is higher than GND, and indicative of negative when the signal is lower than the GND. Also, a to x represent the respective horizontal synchronous periods. As illustrated in this timing chart, if the control signal 321 is high, the paths A are selected in the first selectors 304 and the second selectors 310. As a result, for example, the video signal 401 becomes positive, and the video signal 402 becomes negative. Also, if the control signal 321 is low, the paths B are selected in the first selectors 304 and the second selectors 310. As a result, for example, the video signal 401 becomes negative, and the video signal 402 becomes positive. The same is applied to the video signals 403 to 408.

In this embodiment, the respective four control signals 321 to 324 are signals inverted in polarity by the four horizontal synchronous signals Hsyn and different in phase from each other, and therefore become four pairs of the eight video signals 401 to 408. Also, four line dot inversion in which the same positive and negative pattern is repeated is conducted every four lines on the screen. As a result, control can be conducted so that the alternating polarities on the screen are not visually recognized to be regularly arrayed.

Figure 6:
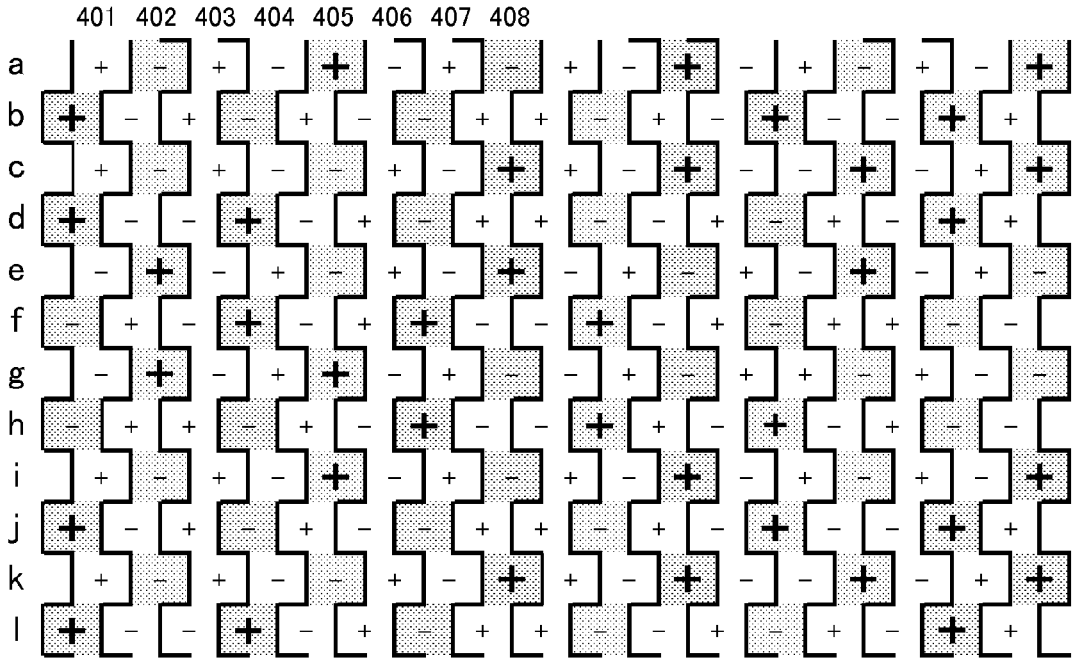
FIG. 6 is a diagram illustrating the polarities of the respective pixels when a monochromatic display is conducted under a signal control in FIG. 5.

FIG. 6 is a diagram illustrating the polarities of the respective pixels when the monochromatic display is conducted in the driver IC 300 under the signal control of FIG. 5. In this embodiment, the color of the monochromatic display is "G (green)", and the hatched pixels are "G" pixels which are display color. Also, in the G pixels, the positive pixels are each indicated by largely and thickly representing a character "+". The "+" polarity of the G pixel is substantially irregularly arrayed, and the stripe pattern is not visually recognized.

FIG. 7 is a diagram illustrating the polarities of the respective pixels when a white display is conducted in the driver IC 300 under the signal control in FIG. 5. In the case of the white display, because all of the pixels become in a high bright state, color coding display is not particularly conducted in the figure. In the figure, the "+" polarity is substantially irregularly arrayed, and the stripe pattern is not visually recognized.

Second Embodiment

A liquid crystal display device according to a second embodiment of the present invention will be described. The configuration of the liquid crystal display device according to the second embodiment is identical with that of the liquid crystal display device according to the first embodiment illustrated in FIGS. 1 to 4, and a repetitive description will be omitted. In the liquid crystal display device according to the second embodiment, because the control signal generated by the control signal generator circuit 330 is different from that in the first embodiment, and therefore the polarities of video signals 421 to 428 are also different.

Figure 8:
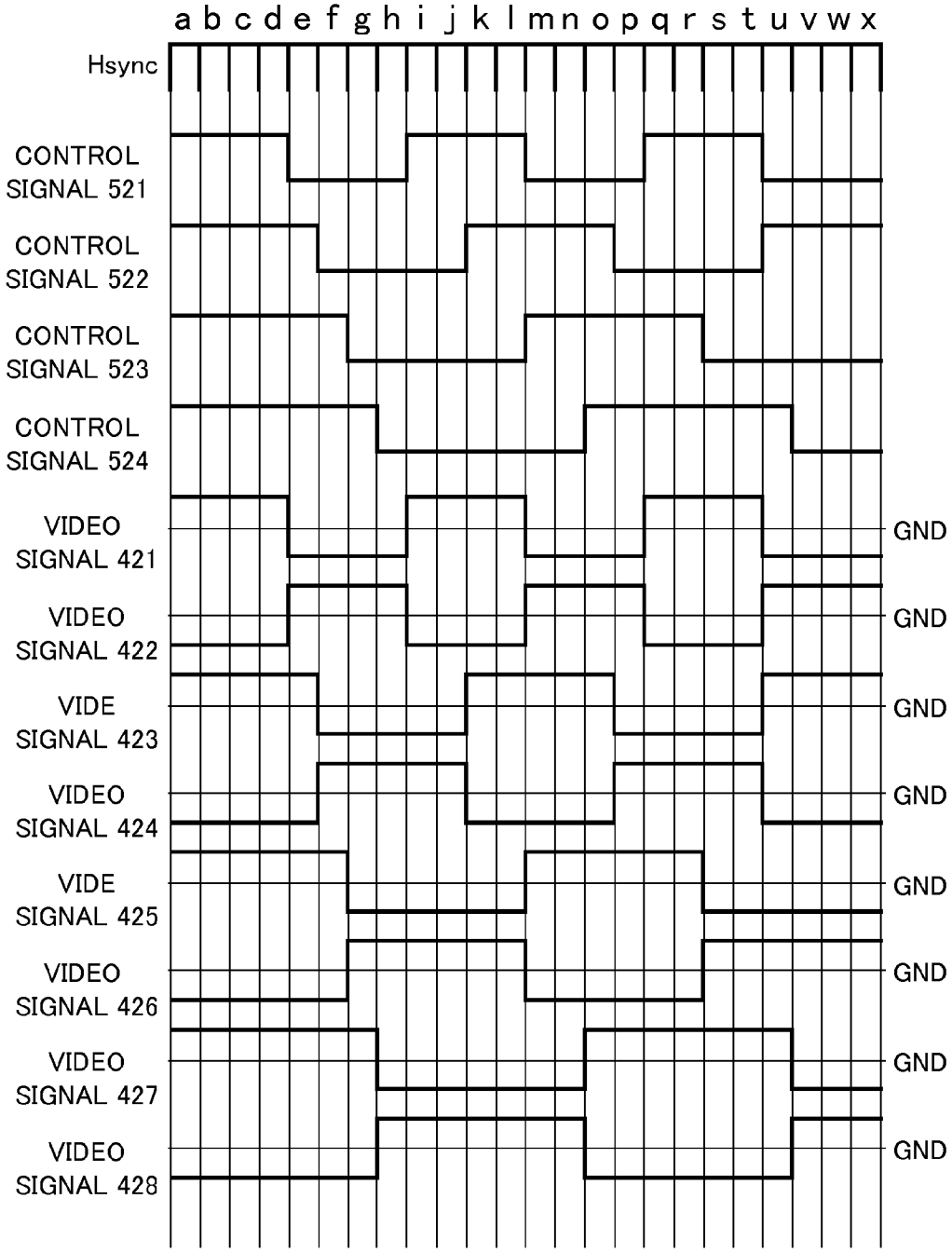
FIG. 8 is a timing chart of control signals and video signals according to a second embodiment.

FIG. 8 is a timing chart of the control signals 321 to 324 and the video signals 421 to 428 according to the second embodiment. As illustrated in the timing chart, the control signals 321 to 324 are inverted in polarity in the respective different cycles of the 4 to 7 horizontal synchronous periods Hsync. The video signals 421 to 428 are inverted in the polarity in response to the control signals 321 to 324 as illustrated in the timing chart.

Figure 9:
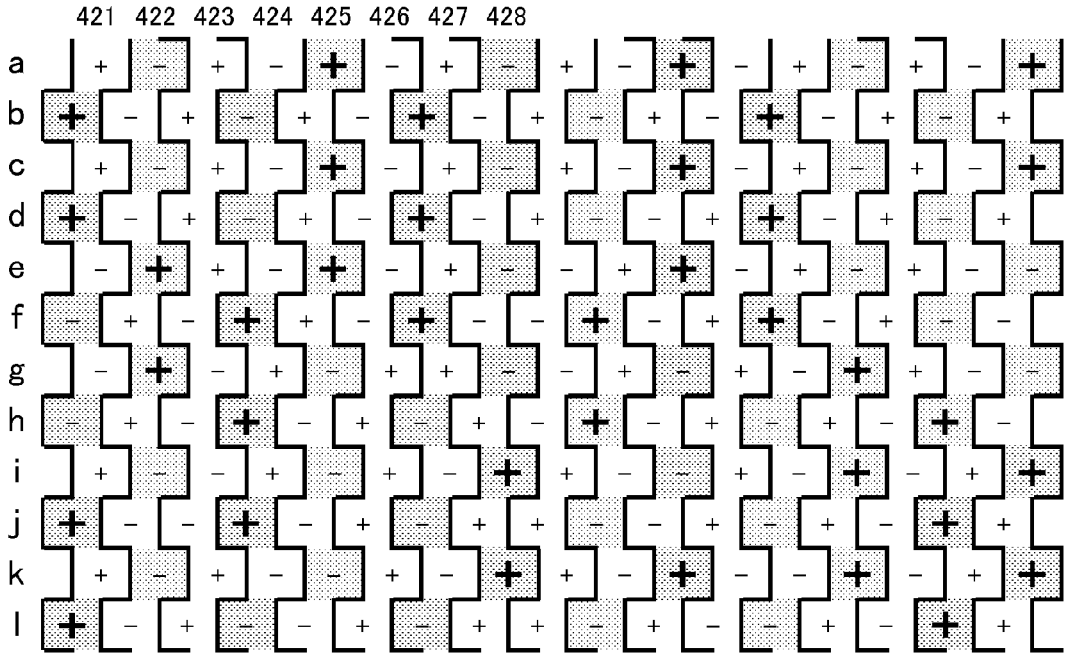
FIG. 9 is a diagram illustrating the polarities of the respective pixels when a monochromatic display is conducted under a signal control in FIG. 8.

FIG. 9 is a diagram illustrating the polarities of the respective pixels when a monochromatic display is conducted in the driver IC 300 under the signal control in FIG. 8. As in FIG. 6, the color of the monochromatic display is "G (green)", and the "G" pixels are hatched. As illustrated in the figure, the "+" polarity of the G pixel is substantially irregularly arrayed, and the stripe pattern is not visually recognized.

FIG. 10 is a diagram illustrating the polarities of the respective pixels when a white display is conducted in the driver IC 300 under the signal control in FIG. 8. Similarly, in the figure, the "+" polarity is substantially irregularly arrayed, and the stripe pattern is not visually recognized.

Thus, control can be conducted so that the alternating polarity is not regularly arrayed on the panel screen by changing the number of polarity inversions of the respective video signals 421 to 428, and the power consumption can be reduced by expanding the polarity inversion period.

Third Embodiment

A description will be given of a liquid crystal display device according to a third embodiment of the present invention. The configuration of the liquid crystal display device according to the third embodiment is identical with that of the liquid crystal display device according to the first embodiment illustrated in FIGS. 1 to 3 except that a driver IC 600 is used in FIG. 3.

Figure 11:
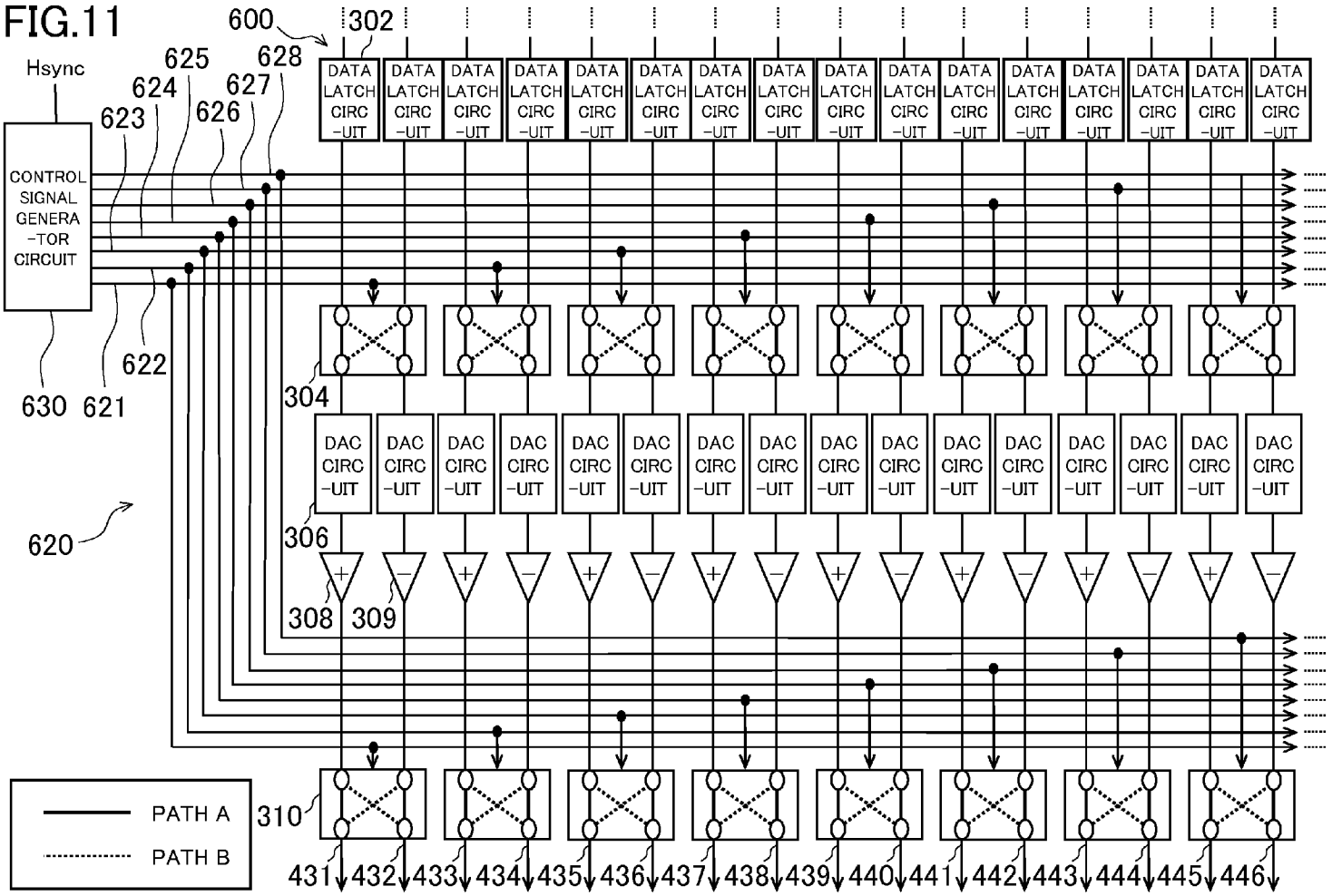
FIG. 11 is a diagram schematically illustrating a part of a circuit within a driver IC according to a third embodiment.

FIG. 11 is a diagram schematically illustrating a part of a circuit within the driver IC 600. The liquid crystal display device according to the third embodiment is different from that of the second embodiment in that there is provided a control signal generator circuit 630 that generates eight control signals 621 to 628 to be supplied to an inversion control signal line 620. Also, 16 video signals 431 to 446 are output in correspondence with those eight control signals 621 to 628. The other configurations are identical with those in the second embodiment, and therefore their description will be omitted.

Figure 12:
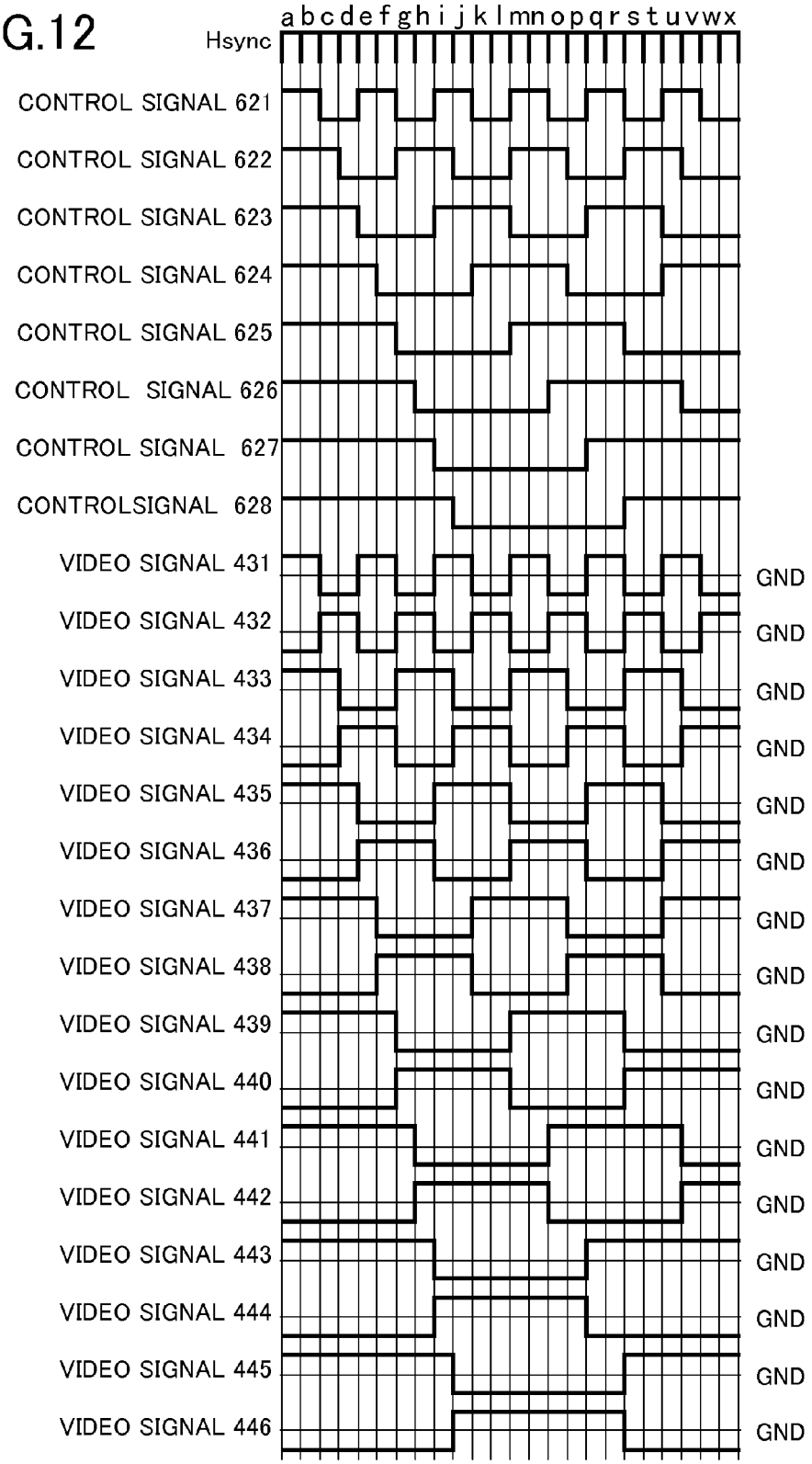
FIG. 12 is a timing chart of control signals and video signals according to a third embodiment.

FIG. 12 is a timing chart of the control signals 621 to 628 and the video signals 431 to 446 according to the third embodiment. As illustrated in this timing chart, the control signals 621 to 628 are inverted in polarity in the respective different cycles of the second to ninth horizontal synchronous periods Hsync. The 16 video signals 431 to 446 are output in correspondence with those eight control signals 621 to 628 as shown in the timing chart.

Figure 13:
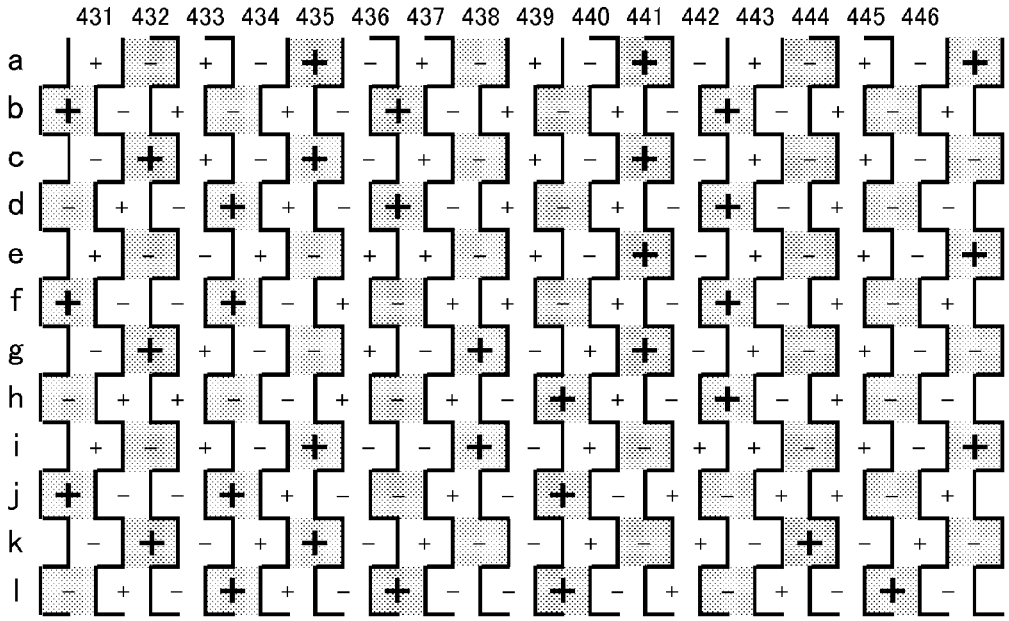
FIG. 13 is a diagram illustrating the polarities of the respective pixels when a monochromatic display is conducted under a signal control in FIG. 12.
Figure 15:
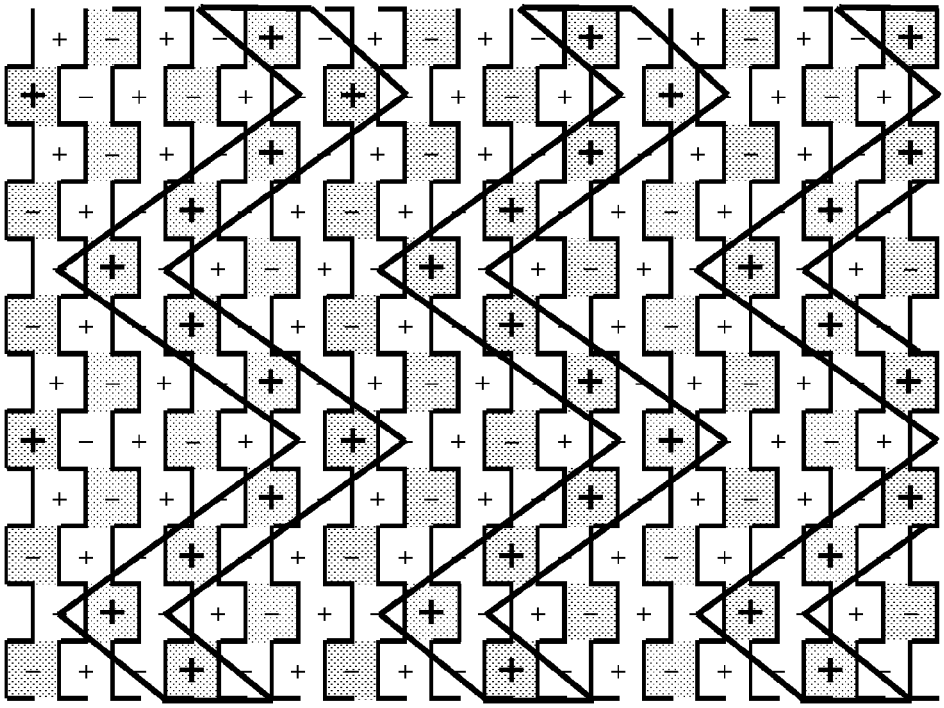
FIG. 15 is a diagram a case in which a monochromatic display of G (green) pixels is conducted in dot inversion where the respective pixels are inverted every three horizontal synchronous periods.
Figure 16:
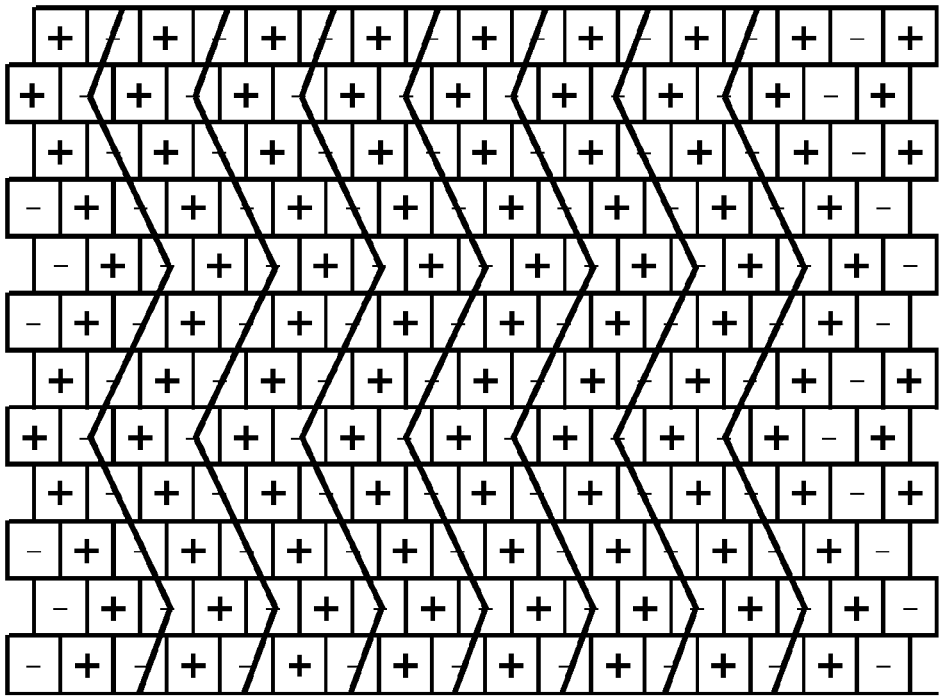
FIG. 16 is a diagram a case in which a white display is conducted in dot inversion where the respective pixels are inverted every three horizontal synchronous periods.
Figure 17:
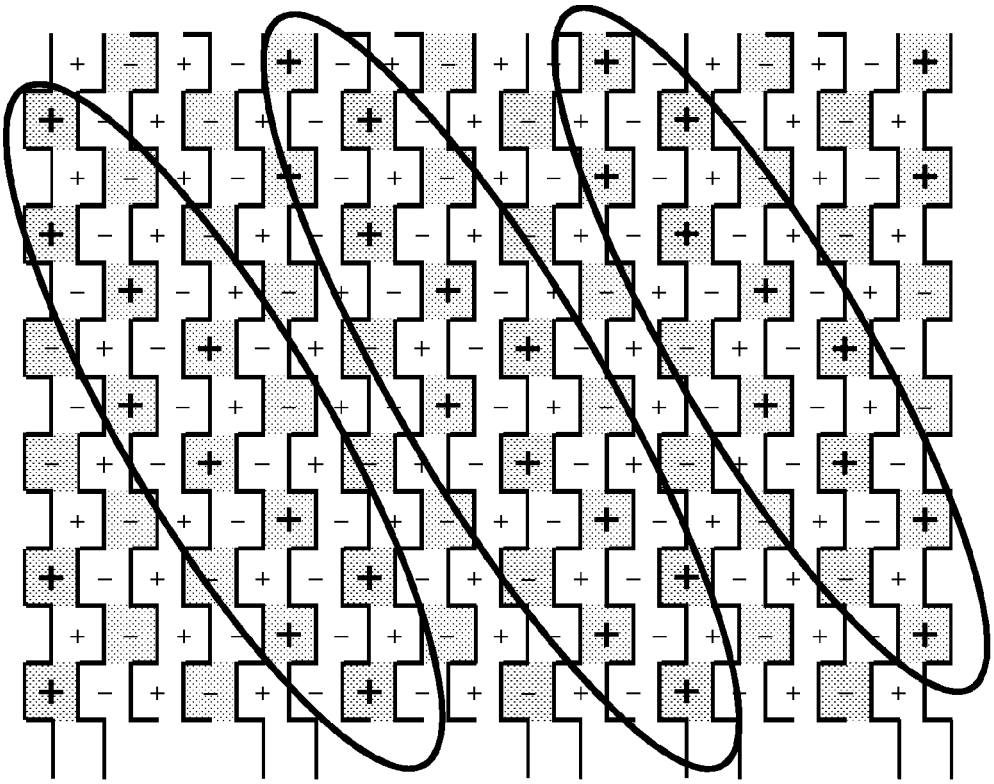
FIG. 17 is a diagram a case in which the monochromatic display of the G (green) pixels is conducted in the dot inversion where the respective pixels are inverted every four horizontal synchronous periods.
Figure 18:
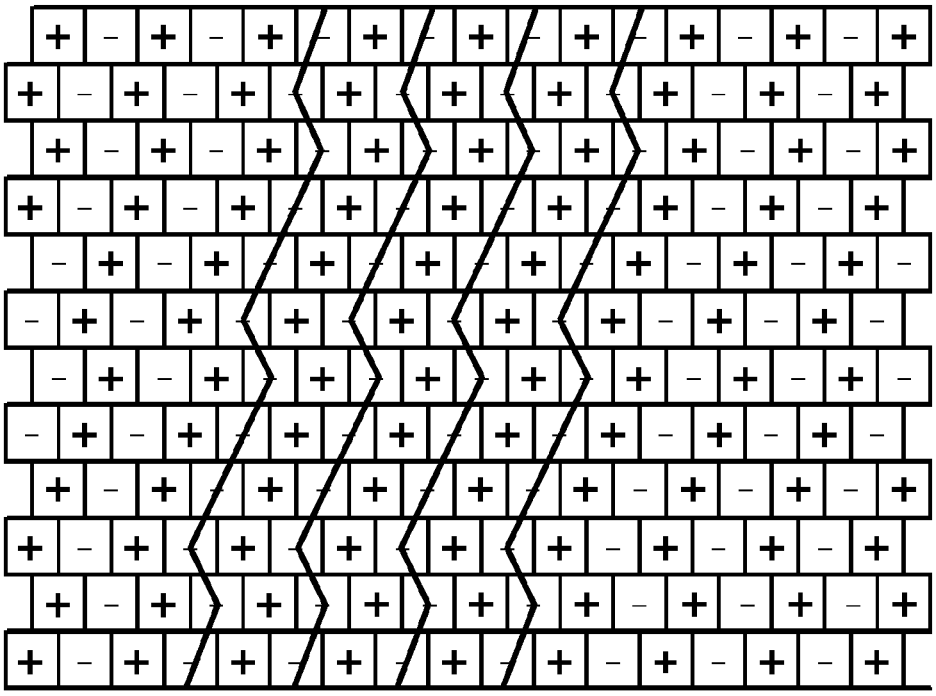
FIG. 18 is a diagram a case in which a white display is conducted in the dot inversion where the respective pixels are inverted every four horizontal synchronous periods.

FIG. 13 is a diagram illustrating the polarities of the respective pixels when the monochromatic display is conducted in the driver IC 600 under the signal control in FIG. 12. As in FIG. 6, a color of the monochromatic display is "G (green)", and the "G" pixels are hatched. As illustrated in the figure, the "+" polarity of the G pixels is substantially irregularly arrayed, and the stripe pattern is not visually recognized.

FIG. 14 is a diagram illustrating the polarities of the respective pixels when a white display is conducted in the driver IC 600 under the signal control in FIG. 12. Also, in this figure, the "+" polarity is substantially irregularly arrayed, and the stripe pattern is not visually recognized.

Thus, the number of combinations of the control conducted so that the alternating polarities are not regularly arrayed on the panel screen is increased more as the number of control signals is increased more, and the number of combinations of the control of the source signal is increased more. Therefore, the occurrence of the visual oblique stripe can be suppressed.

In the above-mentioned respective embodiments, the delta pixel array is described. However, the above embodiments can be applied to vertical stripe array pixels and lateral stripe array pixels by appropriately selecting the period and the phase.

Also, in the above-mentioned respective embodiments, the control signals of the same number as the number of kinds of the control signal lines are provided. However, the same control signal may be supplied to parts of the plurality of control signal lines to the extent where the oblique stripes cannot be visually recognized.

While there have been described what are at present considered to be certain embodiments of the invention, it will be understood that various modifications may be made thereto, and it is intended that the appended claim cover all such modifications as fall within the true spirit and scope of the invention.

What is claimed is:

1. A liquid crystal display device, comprising:

a display area in which a plurality of pixels is arrayed;

a plurality of video signal lines that extends in columns in the display area, and applies a video signal voltage based on a gradation value to the plurality of pixels;

a first, a second, a third and a fourth inversion control signal lines each supplied with an inversion control signal for controlling inversion drive;

a first selector that selects one of a first pair of amplifiers different in the polarity from each other to input signals corresponding to a first pair of adjacent video signal lines on the basis of the inversion control signal that is applied to the first inversion control signal line;

a second selector that selects one of a second pair of amplifiers different in the polarity from each other to input signals corresponding to a second pair of adjacent video signal lines on the basis of the inversion control signal that is applied to the second inversion control signal line, a third selector that selects one of a third pair of amplifiers different in the polarity from each other to input signals corresponding to a third pair of adjacent video signal lines on the basis of the inversion control signal that is applied to the third inversion control signal line; and a fourth selector that selects one of a fourth pair of amplifiers different in the polarity from each other to input signals corresponding to a fourth pair of adjacent video signal lines on the basis of the inversion control signal that is applied to the fourth inversion control signal line, wherein inversion control signals to be applied to the four inversion control signal lines are different from each other.

2. The liquid crystal display device according to claim 1, wherein the at least one inversion control signal is a signal different in cycle from the other inversion control signals.

3. The liquid crystal display device according to claim 1, wherein the at least one inversion control signal is a signal identical in cycle and different in phase from the other inversion control signals.

4. The liquid crystal display device according to any one of claims 1 to 3, wherein a pixel array in the display area is a delta pixel array.

* * * * *